United States Patent [19]

Miller et al.

[11] 4,235,603

[45] Nov. 25, 1980

[54] SOLVENT PRETREATMENT OF FEED COAL FOR BRIQUETTING

[75] Inventors: Michael R. Miller; David M. Martin, both of Ames, Iowa

[73] Assignee: Iowa State University Research Foundation, Inc., Ames, Iowa

[21] Appl. No.: 33,473

[22] Filed: Apr. 26, 1979

[51] Int. Cl.[3] ..... C10L 5/08

[52] U.S. Cl. ..... 44/10 R; 44/10 E

[58] Field of Search ..... 44/1 R, 1 B, 10 E, 15 R, 44/15 A, 10 R

[56] References Cited

U.S. PATENT DOCUMENTS

| | | | |
|---|---|---|---|
| 1,413,666 | 4/1922 | Laucks | 44/1 B |
| 2,652,318 | 9/1953 | McKee | 44/15 R |
| 2,652,354 | 9/1953 | Dryden et al. | 44/15 R |
| 2,838,386 | 6/1958 | Mason | 44/15 R |
| 3,317,289 | 5/1967 | Braun et al. | 44/10 R |
| 4,033,852 | 7/1977 | Horowitz et al. | 44/1 R |

OTHER PUBLICATIONS

Solvent Extraction of Some Australian Coals, J. F. Cudmore, Mechanical & Chem. Eng. Transactions, Nov. 1968, pp. 173–180.

Briquette Binders: A Reappraisal, Waters and Clendenin, Proceedings of 12th Biennial Conf., 1971, pp. 144–155.

*Primary Examiner*—Carl F. Dees

*Attorney, Agent, or Firm*—Zarley, McKee, Thomte, Voorhees & Sease

[57] ABSTRACT

Solvent pretreating coal fines prior to briquetting to provide coal briquettes which have no added binder and which will withstand weathering conditions better than binder containing briquettes. The solvents are generally described as organic Lewis base solvents which are capable of electron donor action, and include among others, acetone, methyl ethyl ketone, and ethylene diamine.

13 Claims, 1 Drawing Figure

SOLVENT PRETREATMENT OF FEED COAL FOR BRIQUETTING

BACKGROUND OF THE INVENTION

This invention relates to the use of coal fines produced as a result of mechanical breakage and crushing that occurs in a coal wash plant to make useful briquettes. Fines as used herein generally refer to those materials which pass through a 48 mesh Tyler sieve screen.

The process of briquetting consists of applying pressure to a mass of coal particles, with or without the addition of a binder to form a compact agglomerate. It has a wide application industrially and is not confined to coal alone. An understanding of the process necessarily involves a knowledge of the cohesive forces between solids, the adhesion of binders, and the rheological behavior of particular masses and agglomerates.

The briquetting process, in essence, is one in which coal particles, typically are covered with an adhesive and pressed into molds. The method entails the basic steps of drying and grinding the coal, mixing it with a binder, heating the mixture, pressing the mixture into molds, and cooling and loading the briquettes. These steps are generally known in the briquetting industry.

Since they are well known, they will not be described in detail herein, except in general terms. For further details see *Chemistry of Coal Utilization,* Supplementary Volume H. H. Lowry, Editor, published by John Wiley & Sons, Chapter 16, pages 675 through 753, the disclosure of which is incorporated herein by reference.

Binders are commonly used, as the name implies, in order to provide greater structural integrity of the briquettes formed during processing.

The two most commonly used binders are pitch and bitumen. The typical range of binder addition is within the order of from about 5% to about 18% by weight, and in some instances as low as 1% to 2%. In Europe, pitch is the most common binder material. It is the residue left when coal tar is distilled. It is composed of a very large number of chemicals ranging in complexity from the fairly simple anthracene compounds to others of comparatively high molecular weight. In its role as a binder, the chemical composition of the pitch is of far less consequence than the physical properties. In producing a briquetting pitch the distillation of coal tar is terminated at such a temperature as will leave a residue which is medium soft. Coal tar pitch is quite expensive, and currently may cost as much as $180 per ton.

Besides expense, coal tar pitch is also known to be carcinogenic to those handling it. Some evidence indicates that it may cause epithelial cancer.

It can therefore be seen that the development of a briquette which will maintain its structural integrity without the use of a pitch binder would have readily apparent advantages.

In the United States, pitch is not commonly used as a binder, but bitumen is used in its place. Bitumen is a material derived from petroleum oil as a distillation residue. It is commonly referred to as asphalt. However, bitumen possesses most of the virtues and faults of coal tar pitch. It has good binding properties but it is expensive, smokey and unpleasant to handle. It therefore would be desirable to develop a process of briquetting which eliminates the need for bitumen binder, as well as pitch binders.

Of course, as heretofore mentioned, the purpose of adding binders in the overall briquetting process is to make briquettes which will maintain their structural integrity during storage, shipment and usage. Such briquettes must also maintain their integrity during "weathering" so that they still will be useful afterwards.

"Weathering" is simply subjection of the briquette to ordinary environmental conditions such as moisture and the like. In a laboratory, weathering tests are normally conducted by soaking the briquette in water for a period of time and then subjecting the briquette to friability testing. Typically the briquette's friability or in other words its structural integrity, is tested by a tumbler test, that is, it is placed in a tumbler, subjected to tumbling action and then the amount of breakage to fines is measured.

Satisfactory briquettes for commercial usage must maintain their integrity after weathering, since they are often subjected to weathering during normal usage.

Accordingly, the primary object of this invention is to prepare briquettes from coal fines, which eliminate the use and necessity for added binder materials such as coal tar pitch and bitumen; and, yet which will provide a briquette which is of good structural integrity, even under weathering conditions, and which eliminates the possible harmful effects which may occur from the use of traditional binders.

The method and manner of accomplishing these as well as other objectives of the invention will become apparent from the detailed description which follows.

SUMMARY OF THE INVENTION

Briquettes are made from coal fines, that is through 48 mesh Tyler screen, by obtaining such fines materials from standard coal treatments, drying the material to about room moisture, treating the material with an organic solvent such as acetone, preferably by spraying application, mixing the solvent treated material, removing the solvent by means such as vacuum means, and thereafter, compressing the dried fines material to form briquettes. The result is a briquette having superior strength after weathering, when compared to conventional binder containing briquettes, untreated briquettes, or raw coal which have been subjected to weathering.

DETAILED DESCRIPTION OF THE INVENTION

Figure 1:
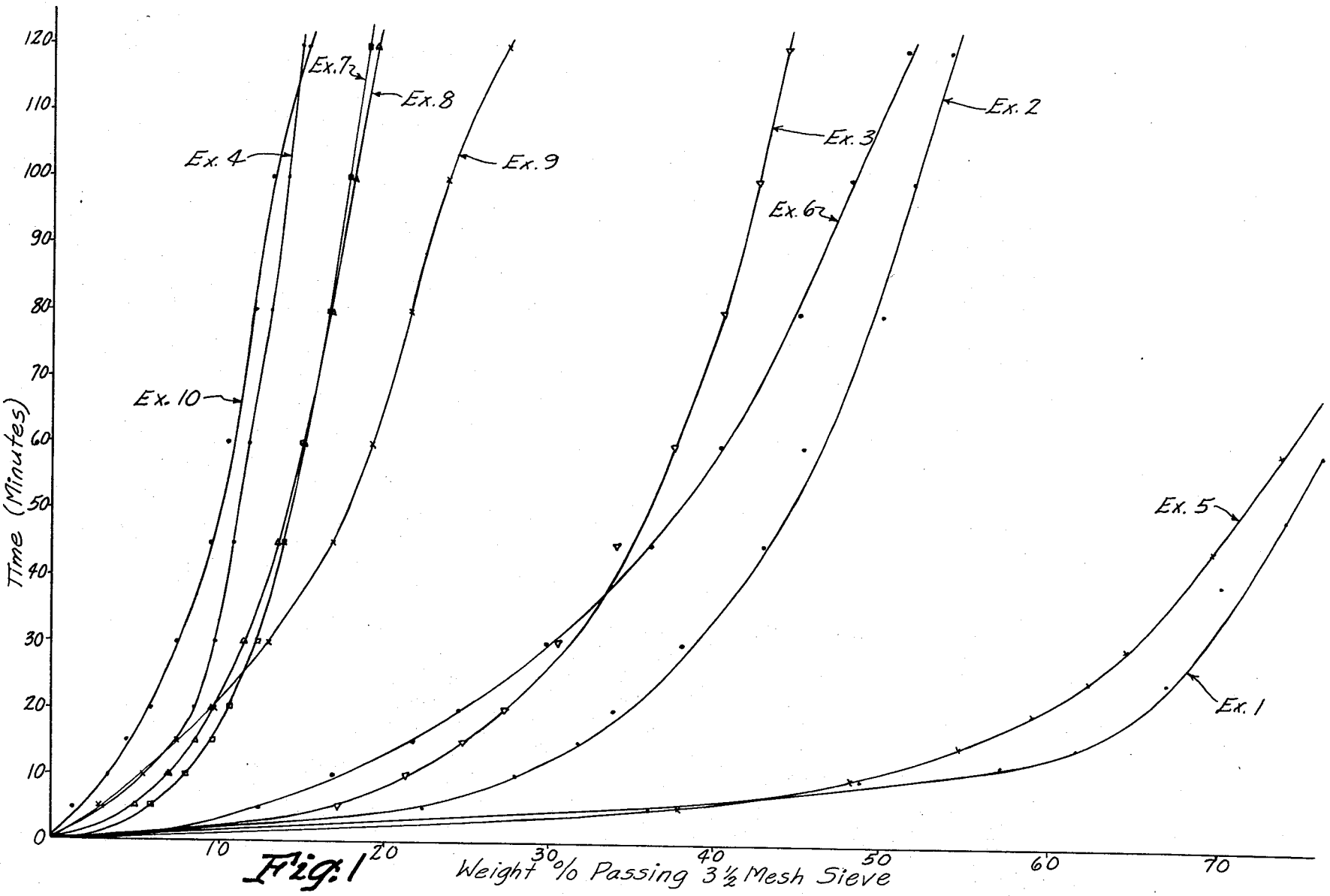
FIG. 1 is a graph showing the results of the structural integrity tests as measured for Examples 1 through 10.

As heretofore mentioned, the starting material, that is the coal fines, for this invention, is generally described as passing through a 48 mesh Tyler sieve. This material is generally defined as fines and an abundance of it is prepared during various coal washing treatments. Lower grade coals, that is, those containing a large amount of sulphur and ash are subjected to pre-washing treatments during processing. Commonly the coal is crushed to usable size, passed through sizing screens, pre-washed and dewatered and concentrated. The exact processing steps will vary depending upon the specific coal being used. In any event, though, a substantial amount of fines material are gathered from these processes. This fines material is the starting material for the briquetting process of this invention.

If desired, in order to provide for ease of processability in subsequent steps, the material can be first size reduced to a substantially uniform size. Preferably if this size reduction step is accomplished, it is size reduced to material which will range in size from through a 60 mesh U.S. standard sieve to a smaller size limit of through a 100 U.S.A. standard sieve screen. This size reduction can occur, if this step is employed, in conventional manners by using known size reduction apparatus such as a ball mill, hammer mill, roller mills or the like.

Assuming that size reduction has been completed, or that the material is being used as obtained directly from the coal treating plant as is, such material is often too wet for treatment in the briquetting process. It is therefore preferable to employ drying as a first step. In the drying step, it is dried to its typical moisture content within the range of from about 2% to less than 30% by weight. It can be dried to lower levels, even 1% to 2% by weight; however, it has been found that dust and fines handling problems occur if it is dryer than 2% by weight.

Drying can be accomplished by vacuum drying. For example, at 110° C. for about one hour for batch sized lots. Many different types of dryers are commonly used in the industry. The vertical cast grade dryer is much used as the horizontal rotating drum dryer is also. For further details on drying conditions see the previously incorporated by reference disclosure relating to general briquetting methods. Generally, drying is at temperatures ranging from 25° C. to 120° C. for periods of from 30 minutes to 24 hours. Generally, the higher the temperature of drying, the shorter the drying time.

After drying, in conventional briquetting, the dried and size reduced material is mixed with binder in the manner previously described. In accordance with the process of this invention, the binder addition step is eliminated and the next step of the process is solvent pretreatment.

In accordance with the solvent treating step, the coal fines material is mixed with a pretreating solvent. The solvent may be applied in any conventional manner, but ideally it is sprayed onto the coal fines material which is continually being agitated in a mixer-blender. The amount of solvent may vary considerably but satisfactory results have been obtained when the amount of solvent is within the range of from about 20% by weight of the coal fines up to about 80% by weight. The objective, of course, is to use the minimum amount of solvent possible but still have the effective results of the solvent pretreatment, namely, the ability to produce a briquette without added binders which is of suitable structural integrity, and which has greater weathering ability than binder added briquettes, or briquettes made without any binder materials. Most preferably the solvent range is within from 20% to about 50% by weight of the coal fines material.

The solvent and the coal fines are agitated in a mixer-blender for sufficient time to allow good contact between the solvent and the surfaces of coal particles. Generally, this mixing time is from five minutes to one-half hour, and more commonly, from ten minutes to twenty minutes. Of course, the exact amount of mixing time will vary depending upon the size of the batch of material being treated.

The solvents which may be utilized in this solvent pretreating process vary considerably from the standpoint of their precise structure and functional groups. However, all of them may generally be described as lower, that is $C_{12}$ or less organic solvents of the Lewis base type. That is, they all characteristically have an unshared electron pair. It is not known precisely how these function in aiding the briquetting process, but it is believed that an unassociated electron pair may perform an important function in the interaction between the coal and the solvent material. Examples of such solvents include lower ketones such as acetone, methyl ethyl ketone, and 2-pentanone. Other effective solvents include amine solvents, such as ethylene diamine and pyridine. It is possible that some alcohol and aldehyde solvents may also be employed. However, methanol is not very satisfactory. But higher alcohols may be. In addition, halogenated hydrocarbons such as methylene chloride have been tried with some success. Some lower aldehydes may also be employed. However, the most preferred solvents, by far, are lower ketone solvents and the most preferred of all is acetone. Acetone is most preferred because of its ease of availability, desirable cost factor considerations, and its boiling point characteristics, which make removal of excess solvent comparatively easy.

After the solvent pretreatment and mixing step heretofore described, excess solvent is removed. This is accomplished by thermal drying or vacuum drying. Vacuum drying has been used effectively with recovery of 98% of the solvent. Such suitable vacuum drying is accomplished at a pressure of 5 inches of mercury at 110° C. for one hour.

The solvent may then be purified and recycled for subsequent use. Of course, the precise manner of solvent removal is not critical, the necessary and economical factor being that as much solvent as possible is recovered from the solvent pretreated coal and recycled for subsequent use. Thus, the important factor is simply removal of as much solvent as possible by whatever means the process operator desires. The vacuum drying is therefore mentioned herein as one illustrative example, it being understood that other drying means may also be employed.

The solvent treated fines material, after vacuum drying, appears as dry powder and it is now ready for use in conventional briquetting procedures.

The precise manner in which the solvent pretreated dry powder fines material is briquetted, is not a critical aspect of this invention. It can be compressed to form briquettes in any conventional manner commonly used in the industry. For example, more commonly used type of briquetting processes are a rotary table press or a double roll press. Either of these may be used satisfactorily. Typically in the briquetting process, the coal fines are elevated to satisfactory compressing temperatures and then passed through the press itself to provide the agglomeration necessary to form a briquette. Temperatures often employed vary within the range of from 25°-150° C. and pressures varying from a few tons per square inch up to as much as 30 tons per square inch. More typically within the range of 5 tons per square inch to 30 tons per square inch, with the time of pressing typically occurring from about ½ second to about 300 seconds.

Other examples of presses which may be employed are ring roll presses, wherein the powder is pressed between a roll and the inner surface of a ring, double roll presses, such as the Komarek-Greaves press, the Apfelbeck press which is a version of the ring roll press, the Krupp-Herglotz press, the Piersol Press, as well as others. The precise manner of operation of such presses is described in the previously incorporated by reference textual material and will therefore not be described in detail herein.

In the examples provided herein for briquetting and weathering tests of the briquettes, large commercial presses were not utilized. The general briquetting procedure employed is set forth below for a typical solvent treated coal briquette.

Sixty grams of air dried coal powder (1 mm top size) are placed in an open container to which 250 ml. of the desired solvent are added. The mixture is air dried and the treated powder is divided into 5.00 gram samples and pressed in a double acting steel die. The coal is placed in a preheated die (70° C.) and subjected to a preload pressure of 1000 psi while the temperature is raised to the desired process temperature. Upon reaching this temperature, generally 150° C., the pressure is raised to 10,000 psi and held there for 300 seconds. The pressure is released and the die and briquette are cooled to 70° C. before discharging the briquette. Before further testing, the briquettes are allowed to stand for 18 hours.

In determining the weatherability of the briquettes, both binder containing briquettes and briquettes prepared without binder, as well as the briquettes prepared from this invention, a standardized weathering test was employed. In this test, the briquettes are soaked in deionized distilled water. After one hour they are removed and air dried for 24 hours before being subjected to a test comparable to ASTM D 441-45 tumble test. In this test, the briquettes are placed in an 8½ inch diameter steel jar mill which has three internal lifter bars and are rotated at 60 rpm for two hours. At various time intervals throughout the test, the coal briquettes are removed and all material retained on a 5.6 mm sieve are weighed and returned to the jar for further tumbling. These data were tabulated as weight percent lost versus time. A 15 percent loss after one hour of tumbling is considered good. For example, raw coal has a 40% loss after one hour of tumbling. All tumble tests were conducted with nine 5.0 gram briquettes.

The untreated coal briquettes are made by the same pressing procedure given above with the exception that they are not subjected to the solvent treatment step. A general procedure would take 60 grams of powdered coal (1 mm top size) and allow it to stand overnight in an open container to allow it to equilibrate with room moisture. The coal is then divided into 5.00 gram samples and handled as described above during briquetting and weathering.

The invention is illustrated but not limited by the following examples showing the solvent pretreatment for specific solvents, and the weatherability of the briquettes produced.

EXAMPLE 1

(Untreated)

For comparison purposes, non-solvent treated fines were briquetted in the following manner. Forty-five grams of pulverized coal (1 mm top size) were exposed to ambient atmosphere for 76 hours. The briquettes were pressed at standard conditions (150° C.-10,000 psi-300 seconds). They were weathered one hour and dried for four hours. The one hour tumble test weight loss was 76.13%.

EXAMPLE 2

(2% Tar Pitch Addition)

To 60 grams of powdered coal (1 mm top size) was added 1.20 grams of ball milled pitch binder. The mixture was stirred to disperse the pitch and allowed to stand overnight. The sample was divided into 5.00 gram samples and pressed at standard conditions (150° C.-10,000 psi-300 seconds). The briquettes sat overnight before being soaked in distilled deionized water for one hour. The soaked briquettes were allowed to dry for 24 hours before the tumbling test was conducted. A one hour weight loss of 45.24% was noted in the tumble test.

EXAMPLE 3

(5% tar pitch addition)

This procedure was the same as above except 3.0 grams of ball milled pitch was added. The one hour tumble test weight loss was 37.44%.

EXAMPLE 4

(10% tar pitch addition)

This procedure was the same as above except 6.0 grams of ball milled pitch was added. The one hour tumble test weight loss was 11.61%. This was a better result than acetone treatment but the cost is about twice as much as the acetone treatment (cost of lost acetone versus the cost of tar pitch).

EXAMPLE 5

(Methanol)

To 126 grams of powdered (pulverized ) coal (1 mm top size, 500 ml. of methanol was added. It was treated for 20 minutes, the solvent was filtered off and the sample was dried in hood for one hour before briquetting. The samples were weathered one hour and air dried 24 hours before tumbling. The one hour weight loss was 76.13%. It should be noted that this was under non-standard pre-treatment conditions.

EXAMPLE 6

Lumps of chunk coal were chosen to approximate the size and weight of the pressed coal briquettes. The coal pieces were subjected to the regular weathering procedure, previously described, and then tumble tested. An average of two tumble tests showed a one hour weight loss was 40.17%.

EXAMPLE 7

(Methyl Ethyl Ketone)

One hundred and eighteen grams of coal was mixed with 500 ml of MEK and allowed to evaporate for 24 hours. The treated coal was pressed and weathered under standard conditions. A one hour tumbling weight loss of 14.94% was observed.

EXAMPLE 8

(Acetone)

To 124.3 grams of coal were added 500 ml of acetone. This slurry was allowed to evaporate for 24 hours under the hood. The coal was pressed at standard conditions and weathered under standard procedures. The one hour tumbling loss was 14.99%.

EXAMPLE 9

(Ethylene Diamine)

To 130 grams of powdered coal were added 300 ml ethylene diamine. The mixture was air dried for 24 hours and then transferred to a vacuum oven. It was held at 25" Hg vacuum and 110° C. for two hours. This was followed by 24 more hours in the hood. After this extensive pretreatment, the coal was pressed at standard conditions subjected to a regular weathering test and tumbled. The one hour weight loss was 19.14%.

EXAMPLE 10

(2-Pentanone)

Sixty grams of coal was slurried with 100 ml. of 2-pentanone. The mixture was air dried in the hood. Five gram samples were pressed under standard conditions and subjected to regular weathering and tumbling tests. A one hour weight loss of 10.40% was observed.

While in each of the above examples, tumble test results were compared at the one hour interval, in fact many other points were measured and graphed for each of the examples.

FIG. 1 is a graph showing each of the examples with the measured times and percent passings through a 5.6 mm sieve.

It can be seen that after weathering, the product of this invention Examples 7, 8, 9 and 10 compare favorably with weathered briquettes containing 10% coal tar pitch, Example 4, a level which is far too high to make such briquettes economical. Those of the invention are far superior to the examples 2 and 3 showing 2% and 5% tar pitch which are common levels and far superior to non-binder treated briquettes, Example 1. It can therefore be seen that the invention accomplishes at least all of its stated objectives.

What is claimed is:

1. A method of preparing briquettes which contain no added binder material but which have weatherability superior to added binder containing briquettes, when compared at conventional binder addition levels, the method comprising, pretreating coal fines with an organic solvent for a period of time sufficient to allow interaction between said coal fines and said solvent, and removing substantially all of said solvent from said solvent treated coal fines, and briquetting said coal fines to provide coal briquettes which contained no added binder material.

2. The process of claim 1 wherein said solvent pretreating is by spraying.

3. The process of claim 1 wherein the amount of solvent in said solvent pretreatment is from about 20% to about 80% by weight of said coal fines.

4. The process of claim 1 wherein the amount of solvent in said solvent pretreatment is from about 20% to about 50% by weight of said coal fines.

5. The process of claim 1 wherein said solvent pretreating occurs while said coal fines are continually being mixed and agitated.

6. The process of claim 5 wherein mixing and agitating continues for from five minutes to 30 minutes.

7. The process of claim 6 wherein mixing and agitating continues for from ten minutes to 20 minutes.

8. The process of claim 1 wherein said solvent removal is accomplished by vacuum drying.

9. The process of claim 8 wherein said solvent is purified and recycled into said solvent pretreating step.

10. The process of claim 1 wherein said organic solvent is a lower ketone.

11. The process of claim 10 wherein said solvent is acetone.

12. The process of claim 1 wherein said coal fines are dried to a moisture content within the range of from about 2% to less than 30% by weight.

13. The product of the process of claim 1.

* * * * *